US006089897A

United States Patent [19]

Boussairy et al.

[11] Patent Number: 6,089,897

[45] Date of Patent: Jul. 18, 2000

[54] CONNECTOR WITH AUTOMATIC INSERTION AND EJECTION

[75] Inventors: Mekki Boussairy, Change; Laurent Bardet, Le Mans, both of France

[73] Assignee: Framatome Connectors International, Courbevoie, France

[21] Appl. No.: 09/264,835

[22] Filed: Mar. 8, 1999

[30] Foreign Application Priority Data

Mar. 13, 1998 [FR] France ..... 98 03109

[51] Int. Cl.[7] ..... H01R 4/50; H01R 13/625

[52] U.S. Cl. ..... 439/347; 439/157

[58] Field of Search ..... 439/152, 157, 439/159, 347, 352, 296, 922

[56] References Cited

U.S. PATENT DOCUMENTS

| | | | |
|---|---|---|---|
| 5,681,184 | 10/1997 | Pamart et al. | 439/595 |
| 5,688,141 | 11/1997 | Dullin | 439/352 |
| 5,928,011 | 7/1999 | Flask et al. | 439/157 |

FOREIGN PATENT DOCUMENTS

| | | |
|---|---|---|
| 9214777 U | 4/1993 | Germany . |
| WO 88/06693 | 9/1988 | WIPO . |
| WO 90/10814 | 9/1990 | WIPO . |
| WO 94/27077 | 11/1994 | WIPO . |

*Primary Examiner*—Brian Sircus
*Assistant Examiner*—Michael C. Zarroli
*Attorney, Agent, or Firm*—Perman & Green, LLP

[57] ABSTRACT

A connector is made with a male body and a female body that can be partially fitted into each other. The female body, within itself, possesses a ring pushed back towards the exterior by a spring. The ring is held inside the female body by a window into which it gets embedded. During the insertion of the male body, a stop of this body pushes the ring back towards the back of the female body. The ring then releases the window which gets embedded in a groove of the male body. The coupling and the fixed joining of the two parts of the connector are then automatic. To uncouple them, it is enough to press on the lever which carries along the window. The spring which pushes back the ring also contributes to the effortless ejection of the male body. It is shown that in no case should force be exerted except in a single direction: a longitudinal direction on the male connector to couple it and a transversal direction on a lever of the window to uncouple the two elements.

10 Claims, 3 Drawing Sheets

CONNECTOR WITH AUTOMATIC INSERTION AND EJECTION

BACKGROUND OF THE INVENTION

1. Field of the Invention

An object of the present invention is a connector with automatic insertion and ejection. It is designed more particularly for electrical and optical applications, but can be used in other fields. The aim of the invention is to facilitate operations of connection and disconnection and to make connectors more reliable while at the same time enabling their miniaturization.

A connector has two bodies, generally a female body and a male body, which can be connected to each other by mechanical means. Within these female and male bodies, there are inserts. The linking of the inserts, which is sheltered, inside the connection of the female and male bodies, provides for the continuity of the function envisaged, namely electrical connection, optical transmission or the like.

2. Description of the Prior Art

For the female and male bodies, a known type of fixed joining is a bayonet type joining and also a screw type joining. However, this type of fixed joining is impractical when the narrowness of the access does not allow the operator to work with his fingers. It is not always possible for the operator to rotate one of these bodies in relation to the other by means of his hands. This is especially the case when the connectors are present in banks, close to one another or even beside one another and above one another. When there are banks of connectors such as this, it is usually necessary to uncouple several of them so as to be able to reach one of them in particular.

There are also prior art automatic insertion connectors known as <<push-pull>>type connectors. In these connectors, an external ring can slide along one of the bodies, the male or female body and in sliding, it can release a bolt that holds the two bodies together. The maneuver is simple during coupling. However, during uncoupling, the fact that numerous connectors are very close to one another does not make it any easier than in the previous case for the operator to work with his hands. Indeed, in this type of connector, however much the coupling may be automatic (the sliding ring escapes and then gets repositioned in an elastic manner), the fact remains that the uncoupling requires two simultaneous actions, one action on the ring and one action on one of the two bodies in order to move one of them away from the other body.

There also exist hinge type joining systems in which the bodies, which are not necessarily male and female, are associated or dissociated by a relative rotation of their alignment. The two bodies are aligned with each other for the connection, and the alignment is broken for the uncoupling. This type of connector too requires a great deal of space for handling.

It is an object of the invention to remedy these drawbacks by proposing a completely different shape for the male and female bodies. According to the invention, it is provided that a latch for joining the male body to the female body is made in the form of a window through which the male body passes. The window is held in the female body. At the time of its insertion, the male body furthermore releases the window in a transversal motion, and the window gets embedded into a relief of the male body so as to block it inside the female body. As a result of this fact, the coupling is very simple, it is automatic. According to an essential characteristic of the invention, the mechanism of the motion of the window is such that the window cannot be shifted if the male body is not inserted into the female body. This makes it possible to prevent a situation wherein, through unwanted handling actions, the window is placed in the path of the male body and, when this male body is inserted, gets broken and makes the connector unusable for its fixed joining function. Hence, the connector made is mechanically reliable and it can therefore be easily miniaturized without any fear of its being insufficiently solid.

An object of the invention therefore is a connector comprising a female body and a male body that can be fitted together longitudinally and, inside these bodies, inserts that are connectable to each other so that, when the bodies are fitted together, these inserts provide for a link between circuits connected to these inserts, wherein:

- the female body possesses a circular window that is transversely mobile in the fitting-in direction of the male body, and a ring that can be shifted within the female body axially in this fitting-in direction and is capable of getting inserted into this window,
- the male body comprising a bore to get threaded into the ring, a stop to push back the ring and a relief to receive an edge of the window.

The invention will be understood more clearly from the following description and from the accompanying drawings. These drawings are given purely by way of an indication and in no way restrict the scope of the invention. Of these figures.

Figure 1:
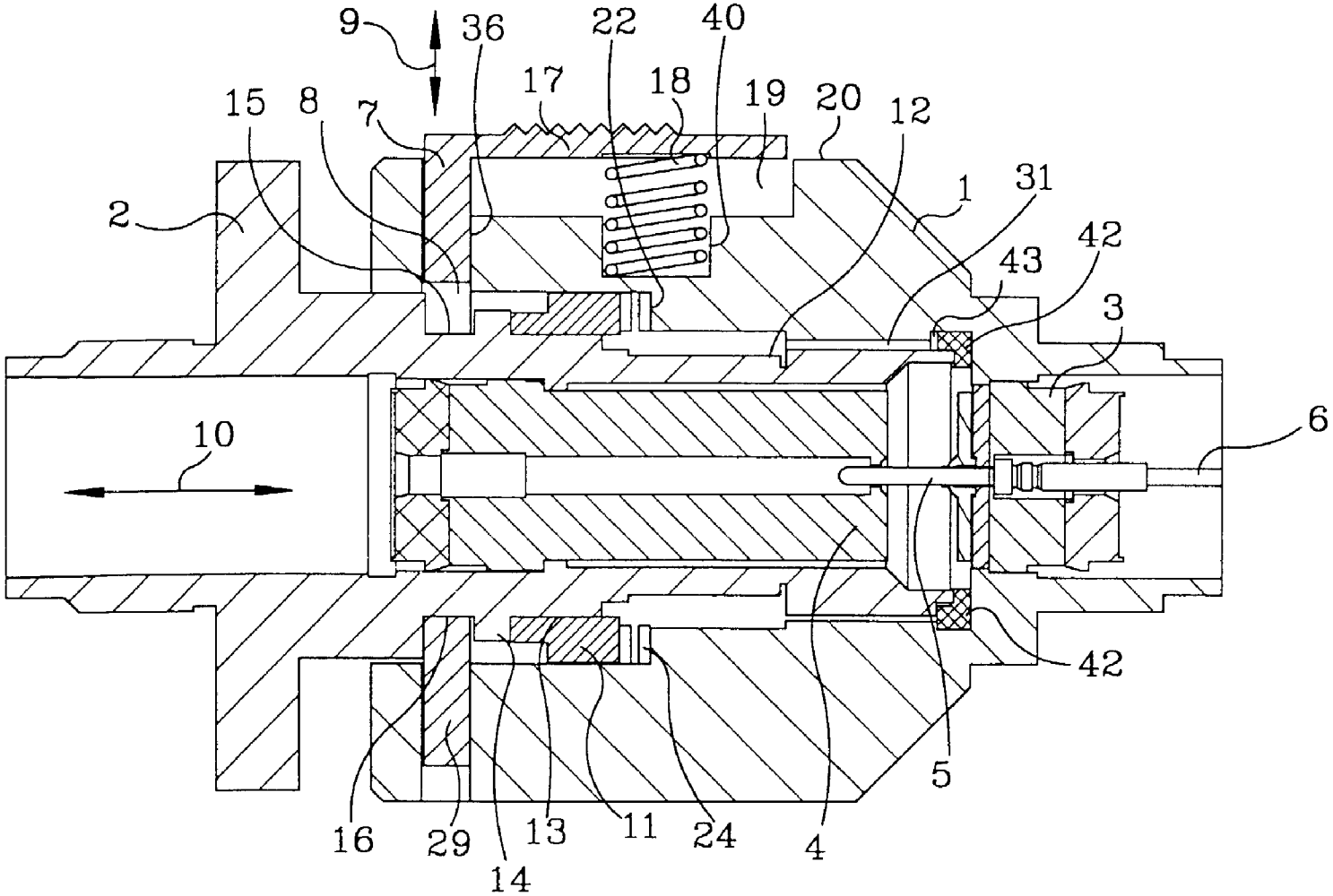
FIG. 1 shows a sectional view of the connector of the invention when the male body is inserted and locked within the female body.

FIG. 1 shows a connector according to the invention. This connector has a female body 1 located to the right of the Figure. Its sectional profile is recalled by broad hatches. The female body 1 has the shape of a receptacle. A male body 2, which too is shown by means of broad hatches, also has a generally hollow shape. The male body 2 is inserted into the female body from the left-hand side of the FIG. 1. Within the female and male bodies, inserts are placed. These inserts, respectively 3 and 4, are mutually connectable. For example, the insert 3 has a male contact 5 connected to a conductor 6. When the two bodies get fitted to each other, the contact 5 gets connected, electrically in this case, by insertion into a female contact (which is not shown and is itself also linked to a conductive wire) of the insert 4. The bodies 1 and 2 and the inserts 3 and 4 preferably have generally circular shapes so as to facilitate their manufacture and assembly.

According to an essential characteristic of the invention, the female body 1 has a window 7 provided with an aperture 8. The aperture 8 is preferably circular. The window 7 is movable in the female body 1 transversely, namely in a direction 9 perpendicular to a longitudinal, left-to-right, fitting in direction 10 of the male body 2 into the female body 1.

The female body 1 also has a ring 10 that can be shifted longitudinally in the female body 1. The ring 11 should be capable of getting imbricated in the aperture 8 of the window 7. The male body 2 for its part has a bore 12 to get threaded into the ring 11.

For this reason, the ring 11 has an internal diameter 13 that is substantially equal to and very slightly greater than the diameter of the bore 12. The male body 2 also has a stop 14 that extends beyond the diameter of the bore and is designed to push the ring 11 back towards the back of the female body 1 at the time of coupling. In the rear of the stop, in relation to the direction of insertion of the male body into the female body, the bore 12 has a relief, preferably a groove 15, to receive an edge 16 of the window. Preferably, the stop 14 and the groove 15 are circular to facilitate both the manufacture of the male body 2 and its insertion and locking into the female body 1.

Figure 2:
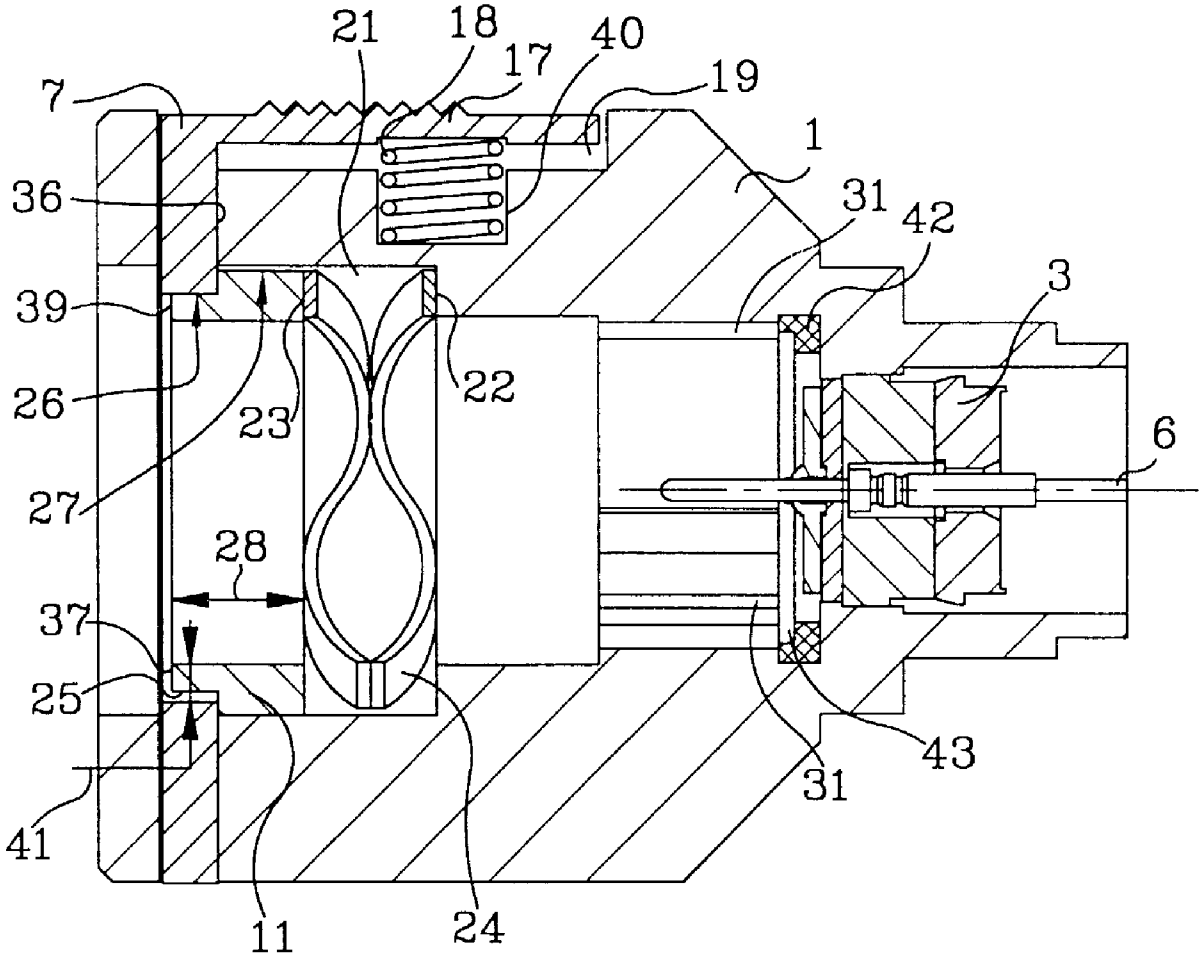
FIG. 2 shows a sectional view of the female body of FIG. 1 in a position to receive the male body.

FIG. 2 repeats the same elements but shows the window 7 in another position, namely a position where the male body 2 has been removed. The window 7 is carried by a lever 17 which, in one example, is overhanging. The lever 17 compresses a spring 18 against the female body 1. Preferably, the female body 1 has a recess or reserved space 19 to receive the lever 17 when this lever is pushed in. When pushed in, the lever 17 is preferably flush with the surface 20 of the female body 1 at the position of the lever 17. On the contrary, when released, the lever projects substantially beyond the surface so that its released position can be perceived by an effect of optical contrast related to this difference in height. Consequently, and especially when connectors like those of the invention are mounted in banks, it can be known if any male body whatsoever is properly fixed to the female body that receives it.

FIG. 2 shows a circular cavity 21 designed to receive the ring 11. The circular cavity 21 thus has a diameter that is substantially equal and slightly greater than the external diameter of the ring 11. Between a bed 22 of the cavity 21 and a rear edge 23 of the ring 11, an axial thrust elastic washer 24 is placed. This washer 24 is preferably a crinkle spring washer or a flat pressure spring, for example of the Smalley type. The crinkles of the spring 24 counter the pushing in of the ring 11 against the bed 22 of the cavity 21. The ring 11 furthermore has a rabbet 25 by which it can be supported in the window 7 when the male body is not inserted. To this end, the ring 11 therefore has a set of steps determining a small external diameter 26 of the ring 11 and a large external diameter 27 of the ring 11.

The small external diameter 26 is designed to be substantially equal to and very slightly smaller than the internal diameter of the aperture 8 of the window 7. On the contrary, the large external diameter 27 is designed to be greater than the diameter of the aperture 8. Consequently, once the ring 11 is placed inside the cavity 21, it can no longer escape: it can no longer cross the aperture 8 of the window 7. However, this shape of the ring 11 with a rabbet could have been replaced by another system. For example, the ring 8 could have been fixed to an annular spring, itself fixed to the bed 22 of the cavity 21.

If, in the position of FIG. 2, the male body 2 is approached, this body will penetrate the ring 11 and the spring 24 by means of its own bore 12. When the stop 14 of the bore 12 approaches the ring 11, the stop carries this ring 11 towards the bed of the cavity 21. It will be observed that, at the time of the insertion, the alignment of the body 2 to the body 1 is favorably guided by the width 28 of the ring 11.

Then, the penetration of the male body continues until the rabbet 25 and the stop 14 cross the perpendicular to the aperture 8. To this end, the external diameter of the stop 14, or its overall dimension if it is not circular, is substantially equal to the small external diameter of the ring 11. Above all, it is smaller than the diameter of the aperture 8. When the stop 14 passes this perpendicular to the aperture 8, the spring 18 pushes the lever 17 in one stroke to move it away from the female body 1. Thus, the window 7 rises and a part 29 of the window 7, opposite the lever 17, gets engaged in the groove 15. This engagement, when it takes place, is so sharp and firm that the connector gives out a clapping sound. This clapping sound is particularly useful for an operator who, in addition to the visual indication given here above, is given an auditory indication that the two bodies have been properly coupled together.

As can be seen in FIG. 2, the particular feature of the invention is that it is impossible to release the lever 17 or even press on it when the male body 2 is not introduced into the female body 1. Indeed, the spring 24, in taking support on the bed 22 of the cavity 21, pushes back the ring 11 whose rabbet gets embedded in the aperture 8 of the window 7. The fact that the rabbet 25 and the aperture 8 are both circular means that the window is not allowed to make any shift. Consequently, firstly, the insertion of the male body 2 will always be done with a very weak longitudinal force (in practice, this force will be limited to the connection force of the inserts 3 and 4 plus the resistance of the spring 24). Secondly, there is no risk that the flanks of the window 11 will obstruct the entry of the female body 1 and thus possibly get broken during a forceful insertion of the male body 2. In particular, there is no risk, during transportation or if the female body 1 is subjected to shocks, when it is uncoupled from the male body 2, that the window 11 will get positioned in this unfortunate position.

Figure 3:
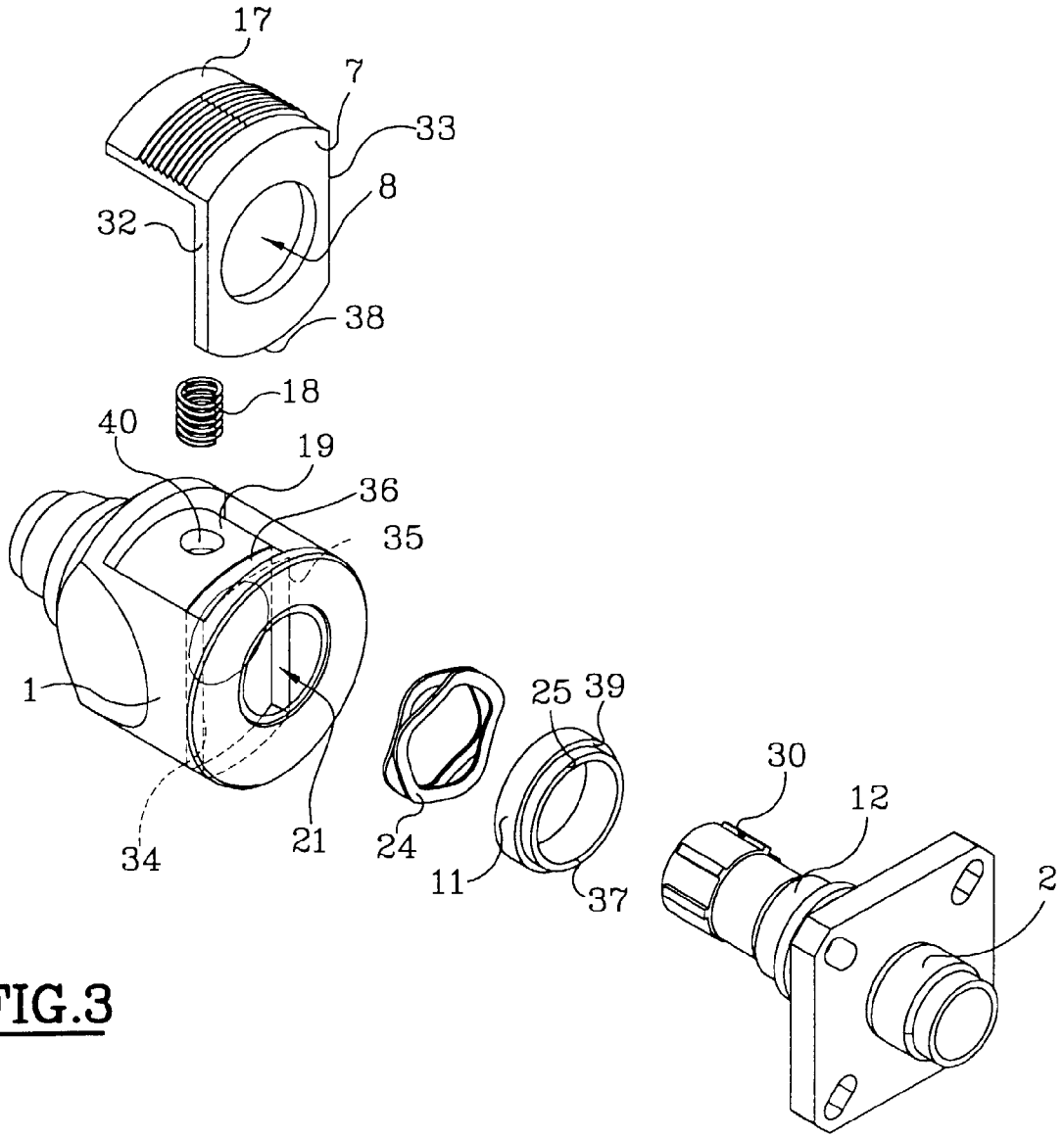
FIG. 3 shows a view in perspective of the different parts of the female body of the invention, furthermore showing the method of its assembly.

FIG. 3 repeats the same elements as those above but shows firstly a particular feature of the male body 2 and secondly a mode of assembly of the different parts of the female body 1.

The bore 12 of the male body 2, preferably in front, in the direction of insertion of the male body 2 into the female body 1, has longitudinal protuberances or ridges 30 distributed unevenly on the rim of the bore 12. The external surface of the ridges 30 is inscribed in a circular cylinder whose diameter is substantially equal to, and very slightly smaller than, the internal diameter of the ring 11. The diameter of the bore 12 at the position of the ridges 30 must of course enable passage through the ring 11 and the spring 24. The ridges 30 are designed to work together with slide channels or grooves 31 shown schematically in FIGS. 1 and 2. The slide channels 31 thus form an error prevention and correction system with the ridges 30 enabling a single position, in rotation, of the male body 2 in the female body 1. This is particularly useful when the connector made is a multipin electrical connector where the correspondence of the male contacts 5 and the female contacts must comply with a specified protocol.

Furthermore, the assembling of the window 7 in the female body 1 is obtained as can be seen in FIG. 3. The window 1 has edges 32 and 33 that are parallel to each other and designed to slide in slide channels 34 and 35 made in the body 1. The slide channels open into the reserved space 19 in the shape of a sectorial slot 36 that receives the window 7. The slide channels 34 and 35 are cut into the mass of the female body. The mounting of the different parts is then as follows. First of all, the spring 24 is placed on the bed of the cavity 21. Then the ring 11 is placed on the spring 24. Then, force is applied to the ring 11, especially in a lower part 37 of the ring 11, so that it moves back from the alignment of the slot 36. When this is done, it becomes possible to slide the window 11 in the slot 36, at least so that a leading edge 38 of the window 7 passes beyond the part 39 of the top of the ring 11. Once this passage has been made, it is enough to place the spring 18 in the reserved space 19 (preferably in a holding blind hole 40) and then push the lever 17 up to the back of the reserved space 19. With a small clearance 41 (see FIG. 2) being made between the diameter of the aperture 8 and the small external diameter 26 of the ring 11, there comes a time when the ring 11 may be pushed back by the spring 24 into this aperture 8 since this diameter 8 is greater than the small diameter 26. At this time, the different parts are blocked with respect to each other and there is no longer any risk of losing a part of them.

The groove 15 preferably has a width equal to the thickness of the window 7 so as to keep the male body 2 in the female body 1 without excessive motion. However, a sliding clearance is provided both in the slide channels 34 and 35 and in the groove 15.

FIGS. 1 and 2 show the presence of a seal 42 placed at the back of the female body 1 in a groove 43 of this body 1. When the male body 2 comes and abuts the back of the female body 1, it is necessary to apply a slight force to the male body 2 and therefore to the seal 42 to enable the locking of the window 7. The seal 42 is then used to achieve the tight sealing of the interior of the connector with respect to the exterior. Thus, in electrical applications, moisture is prevented from corroding the electrical contacts of the insert.

One of the particular features of the invention is that all the parts are circular cylindrical parts, especially the aperture 8 of the window 7. This enables these parts to be made by conventional milling or turning tools, using perfectly mastered techniques.

The various parts presented here may be made of plastic, metal or composite materials that can take this type of embodiment. As the case may be, the different parts may be molded.

To uncouple the male body 2 from the female body 1, it is enough to press on the lever 17 which carries along the window 7. The spring 24 then pushes back the ring 11 which itself contributes furthermore to the effortless ejection of the male body 2. The ejection is automatic. It is enough to press on the lever 17 with a finger, a rod, a screwdriver or a pencil to release the male body from the female body. Hence, in each case, no force should be applied except in a single direction: a direction longitudinal to the male connector in order to couple it, and a direction transversal to a lever of the window to uncouple the two bodies.

It will also be noted that the spring 24 plays a role of retaining the window 7 in the groove 15 owing to the pressure exerted by this spring on the ring 11 which itself places the window flat against one of the flanks of the groove 15. This may be useful if the connector is mounted on an unattached cable, liable to receive shocks. Hence, the lever 17 will be even better held in a raised position by the presence of the spring 24.

What is claimed is:

1. A connector comprising a female body and a male body that can be fitted together longitudinally and, inside these bodies, inserts that are connectable to each other so that, when the bodies are fitted together, these inserts provide for a link between circuits connected to these inserts, wherein:

the female body possesses a circular window that is transversely mobile in the fitting-in direction of the male body, a ring that can be shifted within the female body axially in this fitting-in direction and is capable of getting inserted into this window, the male body comprising a bore to get threaded into the ring, a stop to push back the ring and a relief to receive an edge of the window.

2. A connector according to claim 1, comprising a lever to shift the window and a compressed spring that tends to move the lever away from the female body.

3. A connector according to claim 2, wherein the female body has an external reserved space to receive the lever so that it is flush in the pressed-down position, so as to cause a marked visual difference between this pressed-down position of the lever and a released position of this lever.

4. A connector according to claim 1, wherein the female body comprises a sectorial slot and transversal slide channels to make the window slide therein.

5. A connector according to claim 1, wherein the female body has a circular cavity to receive the ring, a crinkle spring type axial thrust elastic washer placed between the ring and a bed of this circular cavity, this spring pushing back the ring towards an end of the female body.

6. A connector according to claim 1, wherein the ring has a rabbet to take support in the window when the male body is not inserted.

7. A connector according to claim 1, wherein the internal diameter of the circular window is substantially equal to a small external diameter of the ring, the diameter of a circular cavity of the female body is substantially equal to a large external diameter of the ring, the external diameter of the bore of the male body is substantially equal to the internal diameter of the ring, the diameter of the stop is substantially equal to a small external diameter of the ring.

8. A connector according to claim 1, wherein the female body and the bore of the male body possess insertion error correction and prevention devices to orient the male body in the female body.

9. A connector according to claim 1, wherein the female body has a groove provided with a seal.

10. A connector according to claim 1, wherein it is electrical, the inserts possessing electrical contacts, the circuits comprising electrical conductors.

* * * * *

UNITED STATES PATENT AND TRADEMARK OFFICE

CERTIFICATE OF CORRECTION

PATENT NO. : 6,089,897

DATED : 7/18/00

INVENTOR(S) : Mekki Boussairy; Laurent Bardet

It is certified that error appears in the above-identified patent and that said Letters Patent is hereby corrected as shown below:

Col. 6, line 26, Claim 5, "spring" should read --washer--.

Col. 6, line 32, Claim 7, "the internal" should read --an internal--.

Col. 6, line 34, Claim 7, "the diameter" should read --an internal diameter--.

Col. 6, line 37, Claim 7, "the external" should read --an external--.

Col. 6, line 38, Claim 7, "the internal" should read --an internal--.

Col. 6, line 39, Claim 7, "the diameter" should read --an internal diameter--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*